US010724737B2

(12) United States Patent
Petrecca

(10) Patent No.: US 10,724,737 B2
(45) Date of Patent: Jul. 28, 2020

(54) BIOMASS AUTO COMBUSTION CHAMBER

(71) Applicant: MICROSYSTEMFUEL S.R.L., Rome (IT)

(72) Inventor: Luigi Domenico Petrecca, Albano Laziale (IT)

(73) Assignee: MICROSYSTEMFUEL S.R.L., Rome (IT)

( * ) Notice: Subject to any disclaimer, the term of this patent is extended or adjusted under 35 U.S.C. 154(b) by 220 days.

(21) Appl. No.: 16/063,458

(22) PCT Filed: Dec. 23, 2016

(86) PCT No.: PCT/EP2016/082612

§ 371 (c)(1),
(2) Date: Jun. 18, 2018

(87) PCT Pub. No.: WO2017/114793

PCT Pub. Date: Jul. 6, 2017

(65) Prior Publication Data

US 2018/0372312 A1 Dec. 27, 2018

(30) Foreign Application Priority Data

Dec. 29, 2015 (IT) ..... 102015000088624

(51) Int. Cl.

| | |
|---|---|
| ***F23G 5/12*** | (2006.01) |
| ***F23G 5/027*** | (2006.01) |
| ***F23N 3/04*** | (2006.01) |
| ***F23N 5/10*** | (2006.01) |
| ***F23G 5/24*** | (2006.01) |
| ***F23G 5/50*** | (2006.01) |

(52) U.S. Cl.

CPC ..... *F23G 5/0276* (2013.01); *F23G 5/12* (2013.01); *F23G 5/24* (2013.01); *F23G 5/50* (2013.01); *F23N 3/042* (2013.01); *F23N 5/102* (2013.01); *F23G 2201/303* (2013.01); *F23G 2201/40* (2013.01); *F23G 2203/403* (2013.01); *F23G 2209/20* (2013.01); *F23G 2209/26* (2013.01); *F23G 2900/50002* (2013.01); *F23N 2241/18* (2020.01)

(58) Field of Classification Search

CPC . F23G 5/0276; F23G 5/12; F23G 5/50; F23G 5/24; F23G 2900/50002; F23G 2203/403; F23G 2209/26; F23G 2209/20; F23G 2201/303; F23G 2201/40; F23N 5/102; F23N 3/042; F23N 2241/18

See application file for complete search history.

(56) References Cited

U.S. PATENT DOCUMENTS

2003/0010267 A1 1/2003 Tischer
2003/0221597 A1 12/2003 Barba

FOREIGN PATENT DOCUMENTS

IT AN20130114 U1 6/2014
WO 2007036720 A1 4/2007

OTHER PUBLICATIONS

International Search Report for corresponding PCT/EP2016/082612.

*Primary Examiner* — Alfred Basichas
(74) *Attorney, Agent, or Firm* — Egbert, McDaniel & Swartz, PLLC

(57) ABSTRACT

A combustion chamber has an internally hollow tank containing biomass to be combusted and gasified, an air supply to supply air inside the tank, a gas supply connected to a gas source to supply gas inside the tank, and valve or valves electrically connected to the control to control the air flow and the gas flow inside the tank.

11 Claims, 2 Drawing Sheets

BIOMASS AUTO COMBUSTION CHAMBER

The present patent application for industrial invention relates to a biomass auto combustion chamber.

The Italian patent application for utility model AN2013U000114, in the name of the same applicant, discloses a biomass combustion chamber and gasifier for the gasification of the biomass and the combustion of the syngas generated by the biomass.

Such a biomass combustion chamber and gasifier comprises a cylindrical tank wherein the biomass to be gasified is disposed. A rack is disposed inside the cylindrical tank to support the biomass and a stove is disposed in the upper portion of the tank for the combustion of the syngas generated by the biomass.

At the beginning the biomass is ignited, for example by means of an electric resistance, to generate syngas. The syngas is mixed with air and the air-syngas mixture is used as comburent and fuel to ignite the stove. Then, when an operating temperature of approximately 500° C. is reached, the biomass is extinguished and the flame of the stove heats the biomass for producing syngas.

Such a type of gasifier is impaired by some drawbacks which are especially related with the ignition of the biomass. In fact, such a gasifier cannot be used for toxic waste, for example hospital waste and the like, because of the polluting fumes caused when igniting the biomass.

Moreover, the air-syngas mix is not a high grade fuel. In view of the above, difficulties are initially encountered when igniting the biomass and in any case the biomass takes a long time to reach the operating temperature of 500° C., especially in case of combustion of a large biomass quantity.

US2003/221597 discloses a process for the pyrolisis of medical waste and other waste materials.

US2003/010267 discloses a reactor for gasifying and/or melting feed materials, comprising a delivery section by which means the feed materials are introduced, a pyrolisis section which adjoins the delivery section, and means in communication with the pyrolisis section for introducing hot gases in the pyrolisis section.

WO2007/036720 discloses a biomass cooking stove and a method for operating the biomass cooking stove intended to guarantee a high fuel output and reduce the emission of unwanted gas.

The purpose of the present invention is to remedy the drawbacks of the prior art by disclosing a biomass auto combustion chamber that is safe, reliable, versatile and suitable for being used with different types of waste.

Another purpose of the present invention is to disclose such a biomass auto combustion chamber that is effective and able to reduce the biomass combustion time.

These purposes are achieved by the present invention with the characteristics of the independent claim 1.

The combustion chamber of the invention comprises:

- an internally hollow tank, wherein biomass is inserted
- a stove disposed in an upper portion of the tank for the combustion of the syngas generated by the biomass, and
- air supply means to supply into the stove.

The peculiarity of the auto combustion chamber according to the invention consists in that it also comprises:

- gas supply means connected to a gas source to supply gas into the stove,
- control means and valve means to control the air flow and the gas flow in the stove.

Advantageous embodiments of the invention will appear from the dependent claims.

Additional features of the invention will be manifest from the detailed description below, which refers to merely a illustrative, not limiting embodiment, as illustrated in the attached figures, wherein.

Figure 1:
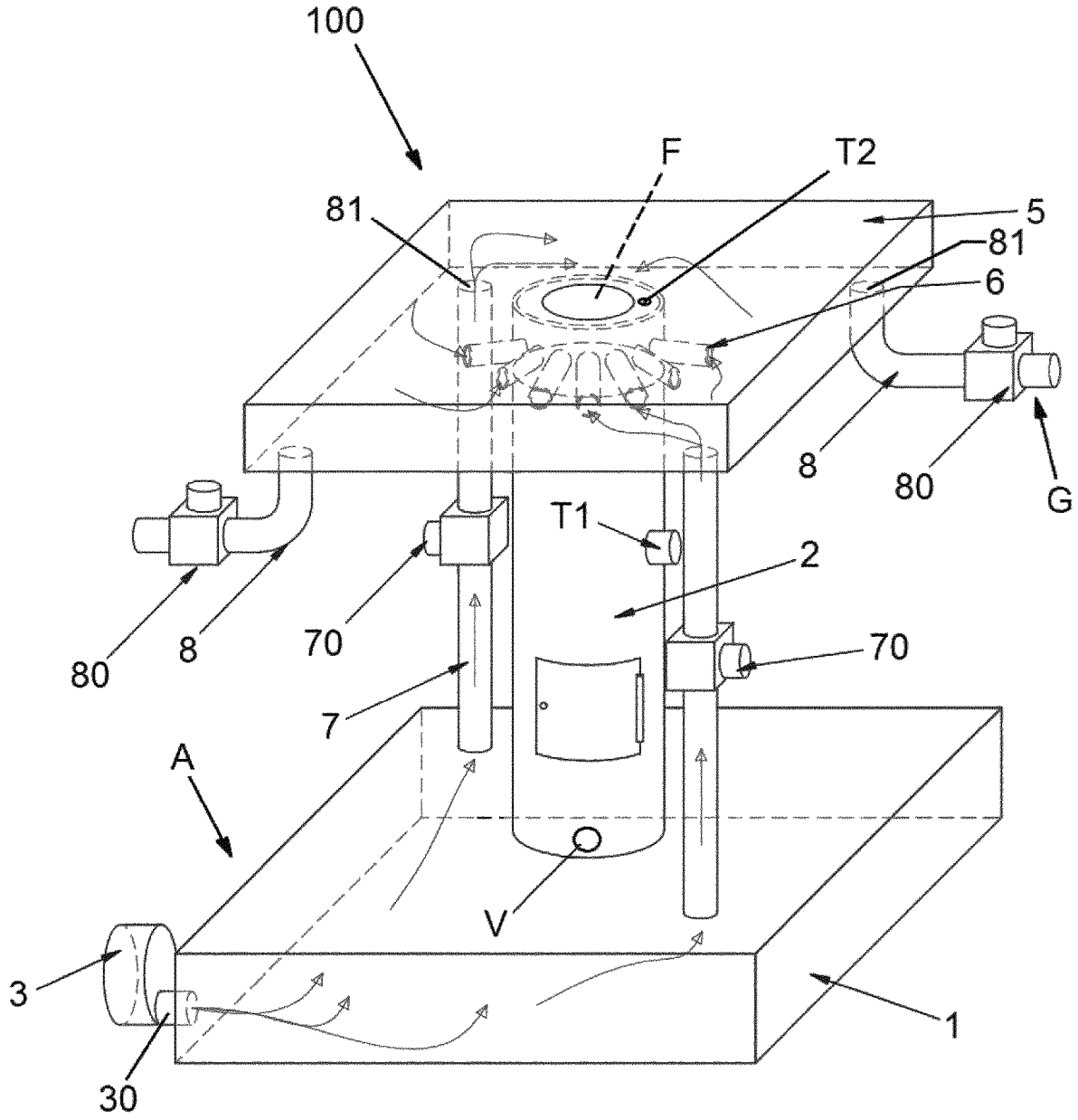
FIG. 1 is a perspective view of the combustion chamber of the invention.

With reference to FIG. 1, a combustion chamber according to the invention is disclosed, which is generally indicated with reference numeral (100).

Figure 2:
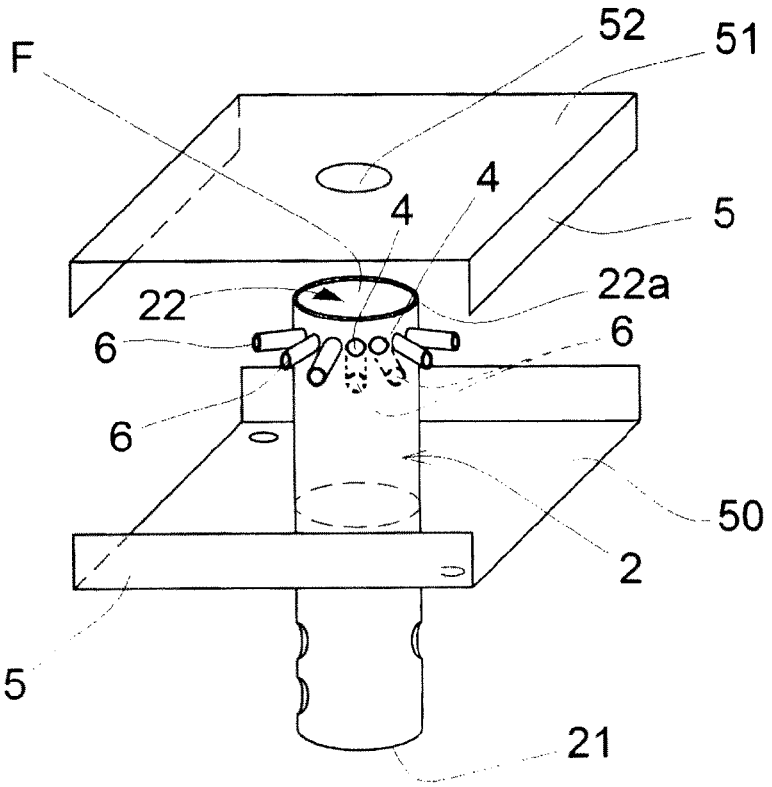
FIG. 2 is a partially exploded perspective view showing a manifold of the combustion chamber of FIG. 1.

With reference to FIG. 2, the combustion chamber (100) comprises a tank (2) wherein the biomass to be gasified is introduced. The tank (2) is internally hollow and comprises a bottom wall (21) whereon the biomass is disposed. The tank (2) has a cylindrical shape with vertical axis. The tank has an upper opening (22) defined by an upper edge (22*a*).

The combustion chamber (100) comprises a stove (F) disposed inside the tank (2). The stove is disposed in an upper part of the tank, above the biomass contained in the tank, in proximity of the upper opening (22) of the tank (2).

The tank (2) comprises holes (4) obtained in proximity of the upper opening (22) of the tank (2), i.e. in correspondence of the stove (F). The holes (4) are circumferentially disposed at the same height from the bottom wall (21) of the tank.

The auto combustion chamber (100) comprises air supply means (A) to supply air into the stove (F).

The air supply means (A) comprise a chamber (1) and a blower (3) comprising a delivery conduit (30) in communication with the chamber (1) to introduce air inside the chamber (1) (FIG. 1). The chamber (1) can be a base whereon the tank (2) is disposed. In any case, the bottom wall (21) of the tank is closed and the interior of the tank is not in communication with the chamber (1).

The air supply means (A) also comprise an internally hollow manifold (5) with parallelepiped shape, which houses an upper portion of the tank (2). The manifold (5) comprises a base wall (50) comprising a hole with the same diameter as the tank (2) and crossed by the upper portion of the tank (2). The manifold (5) comprises an upper wall (51) that partially closes the upper opening (22) of the tank. The upper wall (51) of the manifold (5) is arranged above the upper edge (22*a*) of the tank (2) and is provided with a discharge wall (52) in concentric position with respect to the upper opening (22) of the tank. Said discharge hole (52) of the manifold (5) has a lower diameter than the upper opening (22) of the tank. A duct (not shown in the attached figures) is intended to be inserted in said discharge hole (52) of the upper wall (51) of the manifold (5) to convey the heat generated by the flame of the stove (F) towards an energy generating machine.

With reference to FIG. 1, the air supply means (A) of the combustion chamber (100) comprise two air ducts (7) disposed between the chamber (1) and the manifold (5) to provide communication between the chamber (1) and the interior of the manifold (5). In this way, the air introduced by the blower (3) inside the chamber (1) is conveyed by the air ducts (7) inside the manifold (5).

The combustion chamber (100) comprises gas supply means (G) comprising two gas ducts (8) connected to a gas source (not shown in the figures), such as LPG. The gas ducts (8) comprises outlets (81) in communication with the interior of the manifold (5), in such manner to introduce gas in the manifold. Advantageously, said gas is LPG.

The combustion chamber (100) comprises a plurality of inlet ducts (6) disposed inside the manifold (5) and in communication with the stove (F) inside the tank (2) to convey air or gas into the stove (F). The inlet ducts (6) engage in the holes (4) of the tank, in such manner to radially protrude outwards from the tank. In such a way, the air passing through the air ducts (7) flows into the manifold (5) and is conveyed in the stove (F) through the inlet ducts (6).

A first temperature sensor (T1) is disposed inside the tank (2), at half of the height of the tank (2) to detect the temperature inside the tank (2) that indicates the heating temperature of the biomass. Advantageously, the first temperature sensor (T1) is of electronic type.

The combustion chamber (100) comprises control means (C) and valve means (70, 80) electrically connected to the control means (C) to control the air flow and the gas flow in the stove (F).

The valve means (70, 80) comprise two electrovalves (70) disposed in the air ducts (7) and two electrovalves (80) disposed in the gas ducts (8).

Figure 3:
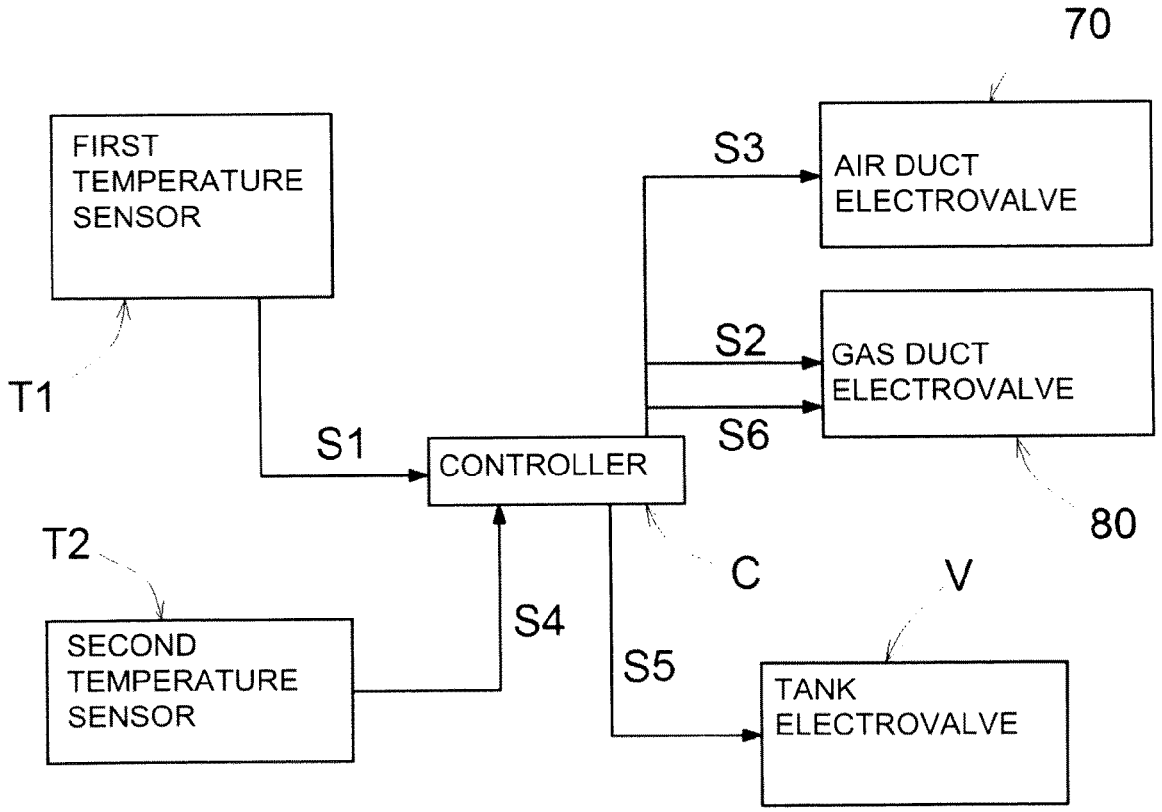
FIG. 3 is a block diagram showing the operation of the combustion chamber of the invention.

The control means comprise a controller (C) (FIG. 3), such as for example a programmable logic controller (PLC), electrically connected to the first temperature sensor (T1) and to the electrovalves (70, 80) of the air ducts and of the gas ducts.

In particular, the first electronic temperature sensor (T1) is configured in such manner to send a command signal (S1) to the controller (C) when the temperature detected inside the tank (2) is equal to an operating temperature comprised between 450° C. and 500° C.

The controller (C) is configured in such manner to send a control signal (S2) to the electrovalves (80) of the gas ducts to close the gas ducts (8), and a command signal (S3) to the electrovalves (70) of the air ducts (7) to open the air ducts (7) when the controller (C) receives the command signal (S1) from the first temperature sensor (T1).

The electrovalves (70) of the air ducts (7) are modulating electrovalves, meaning that the shutter of the electrovalves (70) can move gradually according to the command signal (S3) received from the controller, in such manner to gradually open the air ducts (7).

Consequently, the first temperature sensor (T1) is a temperature-current electronic transducer, in such manner to send a command signal (S) to the controller (C), said command signal (S1) being composed of a current signal comprised for example between 4 and 20 mA, according to the temperature detected inside the tank (2).

As a result, the controller (C) sends a command signal (S3) to the electrovalves (70) of the air ducts, said command signal (S3) being modulated according to the command signal (S1) received from the first temperature sensor (T1) and therefore the command signal (S3) sent by the controller (C) is proportional to the temperature detected by the first temperature sensor (T1). Therefore the shutter of the electrovalve (70) of the air ducts opens according to the temperature detected by the first temperature sensor (T1).

An electrovalve (V) is disposed in a lower portion of the tank (2), putting in communication the interior of the tank with the exterior. In this way, by regulating the electrovalve (V) of the tank, the quantity of air entering the tank from outside is regulated, and therefore the rising speed towards the stove (F) of the syngas produced by the biomass and the temperature of the flame of the stove are regulated.

A second temperature sensor (T2) is disposed in the stove (F) to detect the temperature of the flame of the stove. The second temperature sensor (T2) is connected to the controller (C) to control the electrovalve (V) of the tank.

The second temperature sensor (T2) is configured in such manner to send a command signal (S4) to the controller (C) according to the temperature detected in the stove. When the temperature of the flame of the stove (F) falls below a preset value, for example 800° C., the controller (C) sends a command signal (S5) to the electrovalve (V) of the tank in such manner to supply air inside the tank and increase the temperature of the flame of the stove (F).

The operation of the combustion chamber (100) of the invention is described below.

The biomass to be combusted is loaded inside the tank (2) onto the bottom wall (21).

Initially, the electrovalves (80) of the gas ducts (8) are open and the electrovalves (70) of the air ducts (7) are closed. Therefore the stove (F) is supplied with gas coming from the gas ducts (8).

The stove (F) is ignited in order to generate a flame. Said flame generated by the stove (F) overheats the biomass inside the tank. As a result, the biomass generates syngas that rises towards the stove (F). It must be noted that the biomass is not ignited, but is heated by the flame of the stove. This allows for using toxic waste as biomass, because the biomass is not ignited and no toxic fumes are produced.

When the first temperature sensor (T1) detects a temperature inside the tank (2) that is equal to the operating temperature at which the biomass starts heating and producing syngas, the first temperature sensor (T1) sends the command signal (S1) to the controller (C).

When the controller receives the command signal (S1) from the first temperature sensor (T1), the controller (C) sends the command signal (S2) to the electrovalves (80) to close the gas ducts (8), and a command signal (S3) to the electrovalves (70) to open the air ducts (7). It must be noted that the command signal (S3) is proportional to the temperature detected in the tank, therefore the electrovalves (70) of the air ducts (7) open gradually in such manner to change the air flow rate inside the air ducts (7) and stabilize the flame of the stove (F), keeping the temperature substantially constant.

In this way, the air introduced by the blower (3) inside the chamber (1) passes through the air ducts (7) and is conveyed into the stove (F) by the inlet ducts (6) disposed in the manifold (5).

Inside the stove (F) the syngas generated by overheating the biomass is subject to the action of multiple combusting air jets.

The syngas coming from the tank and the air coming from the inlet ducts (6) of the manifold are immediately mixed because of the strong turbulence generated by the impact between the syngas and the air jets coming from the inlet ducts (6).

The air-syngas mix is ignited, originating a strongly exothermic reaction, generating a first cone of flame with vertex directed upwards, that is to say towards the conduit that conveys the heat to a thermal machine, and a second cone of flame with vertex directed downwards, that is to say towards the biomass, to overheat the biomass.

The first cone of flame determines the combustion of the syngas in correspondence of the stove (F).

The second cone of flame heats the biomass disposed inside the tank. In such a way, the biomass is subject to a hot blast at a very high temperature (approximately 800° C.), originating a gasification process of the biomass.

If, during the gasification of the biomass, the temperature of the flame of the stove (F) falls under a preset value, the second temperature sensor (t2) sends the command signal (S4) to the controller (C). Then the controller (C) sends the command signal (S5) to the electrovalve (V) of the tank, opening the electrovalve (V) that supplies air inside the tank in order to increase the temperature of the flame of the stove (F).

Numerous variations and modifications can be made to the present embodiment of the invention, which are within the reach of an expert of the field, falling in any case within the scope of the invention as disclosed by the attached claims.

The biomass is supplied in the tank (2) in an automatic continuous way. If the biomass is finished, the stove (F) is not longer supplied with syngas and is turned off. In order to avoid the turning off of the stove (F), biomass detection means are provided to detect the presence of biomass in the tank. The biomass detection means are connected to the controller (C). The controller (C) is configured in such a way to send a command signal (S6) to the electrovalves (80) of the gas ducts in order to open the electrovalves (80) and supply gas in the stove (F) in such a way to keep the flame of the stove on also in absence of biomass.

The invention claimed is:

1. Auto combustion chamber comprising:

an internally hollow tank, wherein biomass is disposed to produce syngas, a stove disposed in an upper wall of the tank, above the biomass, for the combustion of the syngas generated by the biomass, air supply means to supply air in the stove, gas supply means connected to a gas source to supply gas in the stove, and control means and valve means to control the air flow and the gas flow in the stove; wherein:

said air supply means comprises at least one air duct in communication with the stove, and said valve means disposed in the air duct and connected to the control means to open and close the air duct;

said auto combustion chamber also comprises a first temperature sensor connected to the control means and disposed inside the tank to detect the temperature inside the tank, and the electrovalve of the air duct is of modulating type and the first temperature sensor is a temperature-current electronic transducer in such manner to send a command signal to the control means which is composed of a current signal proportional to the temperature detected inside the tank.

2. The auto combustion chamber of claim 1, wherein said gas supply means comprise at least one gas duct in communication with the stove and said valve means comprise an electrovalve disposed in the gas duct and connected to the control means to open and close the gas duct.

3. The auto combustion chamber of claim 1, wherein said control means comprise a controller configured in such manner to send a command signal to the electrovalve of the air duct that is modulated according to the command signal received from the first temperature sensor, in such manner to open the air duct according to the temperature detected by the first temperature sensor inside the tank.

4. The auto combustion chamber of claim 1, wherein said air supply means comprise:

a chamber in communication with the stove, and a blower comprising a delivery conduit in communication with the chamber to introduce air inside the chamber.

5. The auto combustion chamber of claim 4, wherein said air supply means also comprise an internally hollow manifold, disposed above the tank and in communication with the stove; said aid duct being disposed between the chamber and the manifold, in such manner to make the air flow from the chamber towards the interior of the manifold.

6. The auto combustion chamber of claim 5, wherein said air supply means also comprise a plurality of inlet ducts disposed inside the manifold and radially connected to the tank in such manner to communicate with the stove.

7. The auto combustion chamber of claim 5, wherein said gas duct comprises an outlet in communication with the interior of the manifold.

8. The auto combustion chamber of claim 1, also comprising:

a second temperature sensor disposed in the stove to detect the temperature of the flame of the stove;

an electrovalve disposed in a lower portion of the tank to adjust the air introduced into the tank from outside, wherein the second temperature sensor and the electrovalve of the tank are connected to the control means and the control means are configured to control the electrovalve according to the temperature detected by said second temperature sensor.

9. Biomass gasification process by means of an auto combustion chamber according to claim 1, wherein said process comprises the following steps:

providing the biomass in the tank of the combustion chamber;

introducing gas in the stove of the auto combustion chamber, in such manner to ignite a flame in the stove that overheats the biomass that generates syngas inside the tank;

interrupting the introduction of gas in the stove of the combustion chamber when the temperature inside the tank reaches an operating temperature comprised between 450° C. and 500° C., and introducing air in the stove of the combustion chamber when the temperature inside the tank reaches an operating temperature comprised between 450° C. and 500° C.

10. The process of claim 9, wherein said step for introducing air in the stove of the combustion chamber provides for detecting the temperature inside the tank and for modulating the introduction of air in the stove according to the temperature detected inside the tank.

11. The process according to claim 9, comprising the following steps:

detecting the temperature of the flame of the stove, regulating the air to be supplied in the tank, according to the temperature detected in the stove.

* * * * *